United States Patent [19]

Yasumune et al.

[11] Patent Number: 4,754,596

[45] Date of Patent: Jul. 5, 1988

[54] VACUUM PACKAGING METHOD AND APPARATUS

[75] Inventors: Masaru Yasumune, Mihara; Junsaku Yamada, Onomichi, both of Japan

[73] Assignees: Furukawa Mfg. Co., Ltd., Tokyo; ECS Corp., Hiroshima, both of Japan

[21] Appl. No.: 7,637

[22] Filed: Jan. 28, 1987

[51] Int. Cl.[4] ..... B65B 31/00

[52] U.S. Cl. ..... 53/434; 53/479; 53/512; 53/372; 53/373

[58] Field of Search ..... 53/86, 91, 95, 373, 53/434, 477, 481, 512, 479, 372

[56] References Cited

U.S. PATENT DOCUMENTS

| | | | |
|---|---|---|---|
| 2,630,955 | 3/1953 | Moses et al. | 53/95 |
| 2,740,243 | 4/1956 | Mahaffy | 53/95 |
| 3,795,085 | 3/1974 | Andre et al. | 53/512 |
| 3,958,391 | 5/1976 | Kujubu | 53/434 |
| 4,578,928 | 4/1986 | Andre et al. | 53/512 |
| 4,583,347 | 4/1986 | Nielsen | 53/512 X |
| 4,586,320 | 5/1986 | Takai et al. | 53/512 |

*Primary Examiner*—Robert L. Spruill
*Assistant Examiner*—Steven P. Weihrouch
*Attorney, Agent, or Firm*—Parkhurst & Oliff

[57] ABSTRACT

In a vacuum packaging apparatus for packaging relatively large articles, a rotary valve is provided over a turntable having a plurality of vacuum chambers at its periphery so that an amount of air is supplementarily discharged from a vacuum chamber into one of other vacuum chambers before a complete vacuum is made and that a small amount of atmospheric air is sucked into the chamber to shrink preliminarily a packaging bag before its open end is sealed.

9 Claims, 11 Drawing Sheets

VACUUM PACKAGING METHOD AND APPARATUS

BACKGROUND OF THE INVENTION

This invention relates to a vacuum packaging method and apparatus for packaging relatively large foodstuffs such as livestock meat and block cheese or other articles with indeterminate shapes through the use of packaging bags of a heat-shrinkable plastic film (thermoplastic film) in a vacuum environment.

It is well known to package foodstuffs such as livestock meat with thermoplastic packaging bags in a vacuum environment. For this purpose, the foodstuffs to be packaged are supplied into a plurality of vacuum chambers disposed on the periphery of a turntable. This typee of a vacuum packaging apparatus is called a rotary chamber type. Some of this type of apparatuses are disclosed in U.S. Pat. Nos. 2,630,955, 2,740,243 and 3,598,391.

In these apparatuses, eight vacuum chambers are disposed at equal space intervals on the periphery of a turntable which is rotated at a constant speed. At an angular position of the turntable, a packaging bag containing an article therein in a state wherein one end of the packaging bag is open is supplied onto a support plate of a vacuum chamber. After the support plate receives the packaging bag, the vacuum chamber is closed to make a vacuum therein (vacuum process) and then the opening of the packaging bag is sealed by a heated seal bar disposed in the vacuum chamber (sealing process). The sealed portion of the packaging bag is cooled down for some seconds in a state wherein the sealed portion is held by the sealed bar and a pillow head located on the support plate. After the completion of the sealing process, the vacuum chamber is opened to discharge the packaged bag and thereafter an article to be packaged is fed onto the support plate (bag loading and unloading process). In this manner, a new packaging bag is packaged in a vacuum environment during one rotation of the vacuum chamber and the three processes need a certain period of time, that is, each of the processes needs a certain angular range of the turntable, respectively.

Furthermore, in these packaging apparatuses, the turntable is normally rotated at almost the maximum speed in order to increase packaging efficiency. Even if the number of the vacuum chambers is decreased to four in order to make a packaging apparatus small, each process needs a certain period of time and the period cannot be shortened easily. Accordingly, it is not possible to make a packaging apparatus compact or light in weight while maintaining a certain speed suitable for processing the packaging bags efficiently.

SUMMARY OF THE INVENTION

It is an object of the present invention to provide a vacuum packaging method and apparatus which can be made compact in size and light in weight while maintaining a necessary speed suitable for processing packaging bags efficiently.

According to one aspect of this invention, there is provided a method for packaging relatively large articles in a plurality of vacuum chambers each comprising a vacuum box and a support plate and disposed on a periphery of a turntable, which comprises steps of: (a) feeding each article to be packaged onto a support plate of a vacuum chamber at an angular position of the turntable in a state wherein the article is accommodated in a packaging bag, at least one end of which is opened; (b) discharging an amount of air in the vacuum chamber containing the article therefrom into one of other vacuum chambers which is disposed at a position opposite to the vacuum chamber with respect to an axis of the turntable so that pressure of the vacuum chamber is decreased to an intermediate level, this sucking step being carried out shortly after the vacuum chamber is closed; (c) making a vacuum in the vacuum chamber while the vacuum chamber moves through a predetermined angular range of the turntable; (d) sucking a small amount of atmospheric air into the vacuum chamber in order to shrink preliminarily the packaging bag; (e) sealing the open end of the packaging bag by heating it while holding it tightly; (f) sucking an amount of air in a backward vacuum chamber disposed at a position opposite to the vacuum chamber with respect to the axis of the turntable into the forward chamber having been packaged; (g) sucking atmospheric air into the vacuum chamber to open it; and (h) discharging the article having been packaged, each above step being carried out during one rotation of the turntable.

According to another aspect of this invention, there is provided an apparatus for packaging relatively large articles with packaging bags in a vacuum environment, which comprises: (a) a plurality of vacuum chambers each comprisisng a vacuum box capable of opening and closing and a support plate on which each article accommodated in a packaging bag is laid and disposed on a periphery of a turntaable rotating at a speed; (b) means for opening and closing the vacuum box with respect to the support plate; (c) a rotary valve for controlling air pressure of each vacuum chamber, the rotary valve comprising a first port for discharging an amount of air in a vacuum chamber containing the article therefrom into one of other vacuum chambers which is disposed at a position opposite to the vacuum chamber with respect to an axis of the turntable, a second port for sucking air in each vacuum chamber to make a vacuum therein, a third port for sucking a small amount of atmospheric air into each vacuum chamber for preliminary shrinkage of the packaging bag, a fourth port for sucking an amount of air in a backward vacuum chamber connected to the first port into the forward vacuum chamber which is disposed at a position opposite to the backward vacuum chamber with respect to the axis of the turntable, a fifth port for sucking sufficient atmospheric air into each vacuum chamber and a passage for connecting the first port to the fourth port, the first to fifth ports being arranged in this order in the rotational direction of the turntable so that each chamber is periodically connected to the first to fifth chambers in this order during one rotation of the turntable; (d) means for discharging the article having been packaged with the packaging bag from the support plate; and (e) means for feeding each of new articles onto each support plate, each article being accommodated in the packaging bag with at least its one end open.

DETAILED DESCRIPTION OF THE INVENTION

Figure 1:
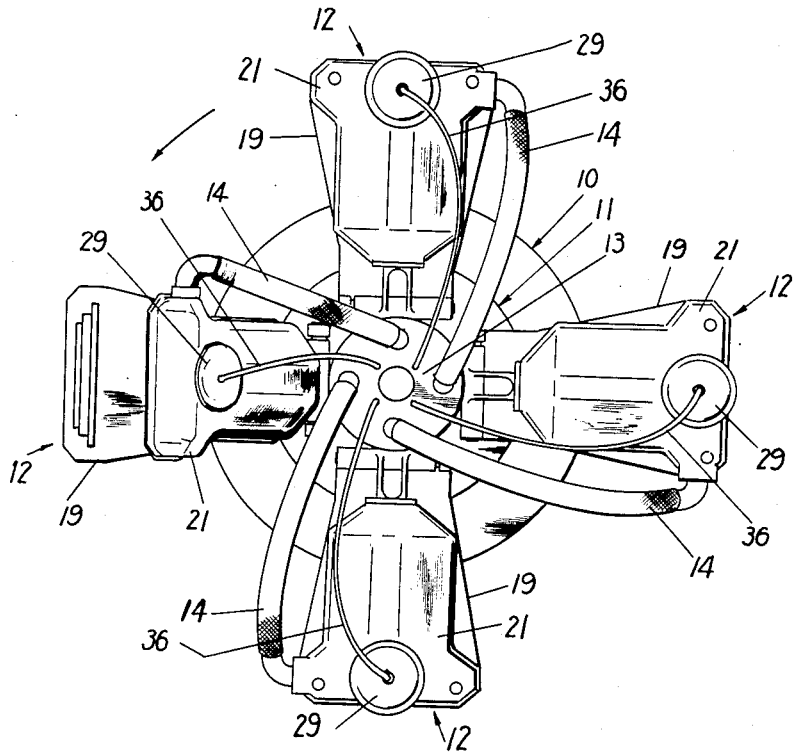
FIG. 1 is a plan view of a vacuum packaging apparatus according to this invention.
Figure 2:
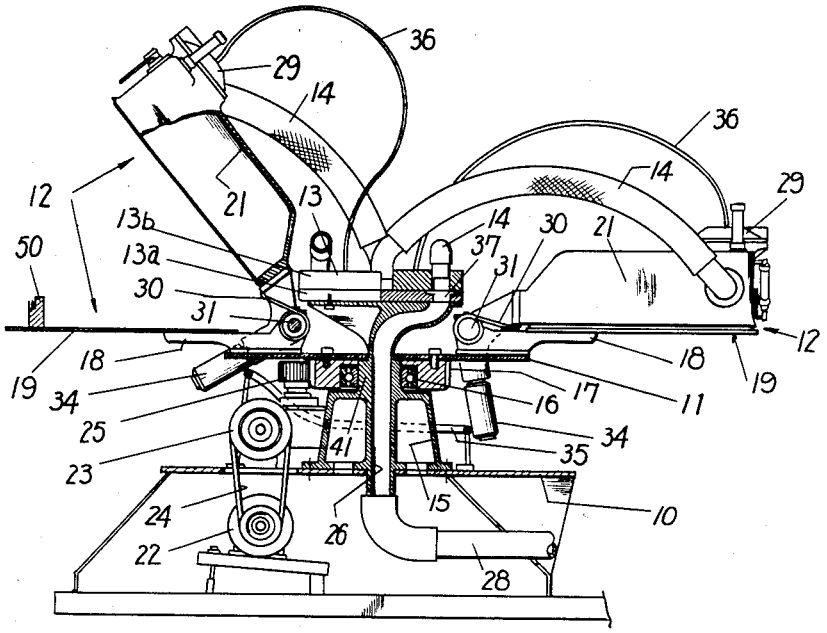
FIG. 2 is an elevational view, partly in section, of the packaging apparatus.

In FIGS. 1 and 2, a vacuum packaging apparatus of this invention has a base frame 10 over which a circular turntable 11 is mounted through a vertical stand 15. Four vacuum chambers 12, 12, . . . 12 are projected radially outwardly from the periphery of the turntable 11 at equal angular intervals (90°). Each chamber comprises a support plate 19 for supporting a relatively large article to be packaged such as livestock meat for food and block cheese and a vacuum box 21 for opening and closing the chamber 12.

Over the center of the turntable 11 is disposed a rotary valve 13 which is mounted on a flat top of a column 41 erected at the center of the stand 15. The column 41 has an air passage 26 therein, the upper end of which is connectd to the rotary valve 13 and the lower end of which is connected to a pipe 28 extended from a vacuum pump (not shown).

A relatively large gear 17 is rotatably supported around the column 41 via a bearing 16 and the circular turntable 11 is fixed to the upper surface of the gear 17. The teeth of the gear 17 are engaged with those of a pinion 25 connected to a reduction gear 23. The gear 23 is connected to a driving motor 22 through a belt 24. Thus, the turntable 11 is rotated continuously at a constant speed.

Figure 3:
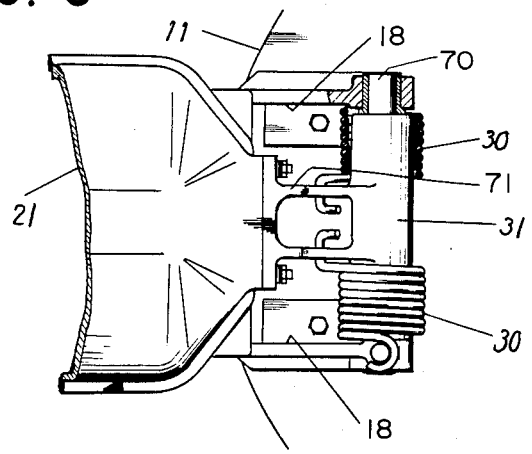
FIG. 3 is a plan view, partly in section, of the root portion of a vacuum box.

On the periphery of the turntable 11 are provided four pairs of support arms 18, 18, . . . 18, each pair of which supports the support plate 19 for closing the bottom of the vacuum box 21. In each pair of the support arms 18, a pivot pin 31 is pivotably engaged, at its opposite ends, with respective root portions of the support arms 18 as shown in FIG. 3. The pivot pin 31 is connected to the inner end of the vacuum box 21 via connecting arm 71. Around the opposite ends of the pivot pin 31 are wound two coil springs 30, 30 for urging the vacuum box 21 upward. One end of each coil spring 30 is engaged with the lower portion of the connecting arm 71 while the other end thereof is engaged with the root portion of the support arm 18. The spring force of two coil springs 30 is not strong enough to raise each vacuum box 21 away from the support plate 19.

Figure 4:
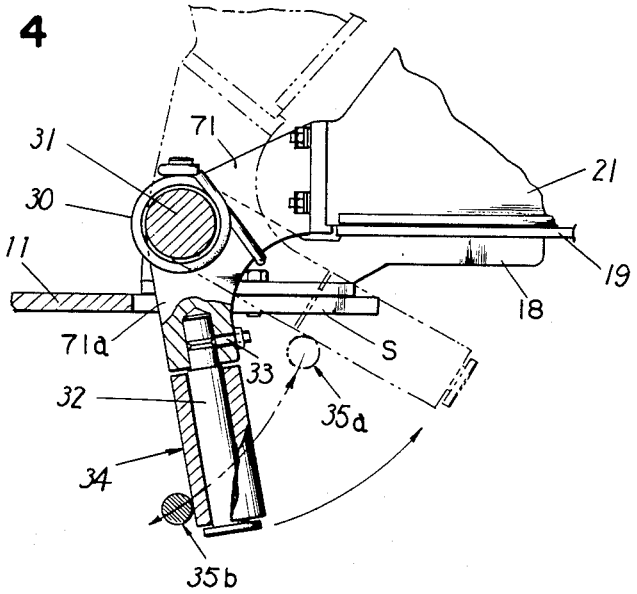
FIG. 4 is an elevational view, partly in section, of the root portion of the vacuum box.
Figure 5:
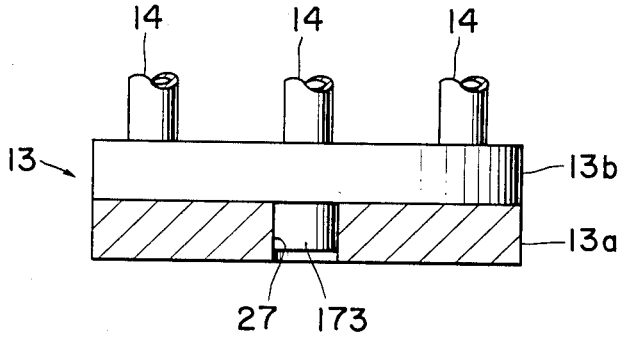
FIG. 5 is a vertical sectional view of a rotary valve.
Figure 19:
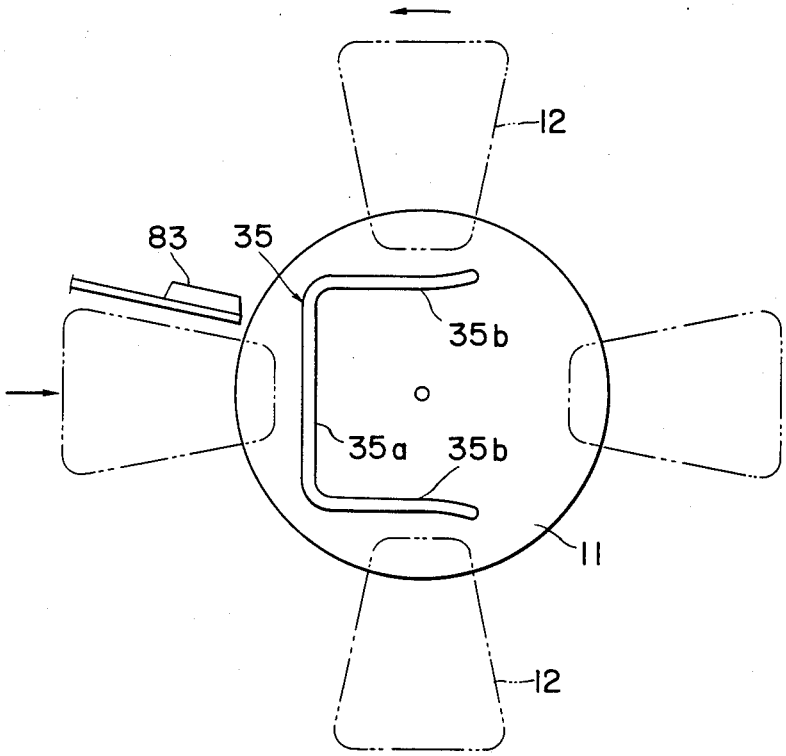
FIG. 19 is a plan view of the vacuum packaging apparatus.
Figure 20:
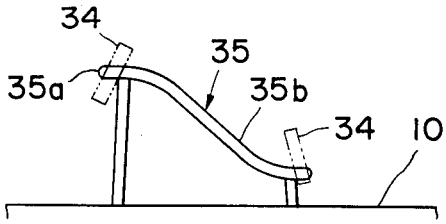
FIG. 20 is a side elevational view of a guide rail to open and close the vacuum box.

The connecting arm 71 is in the shape of a boomerang as shown in FIG. 4, and its lower portion **71*a* holds a pin 32 with a bolt 33. The lower portion 71*a* extends through a slit S formed on the periphery of the turntable 11. A roller 34 is rotatably held by the pin 32 and guided along a guide rail 35 disposed around the stand 15 as shown in FIGS. 19 and 20 in order to open the vacuum box 21. The rail 35 has a horizontal portion 35*a* extending along a tangential line of the turntable 11 and two inclined portions 35*b*, 35*b* extending downwardly in the direction approximately perpendicular to the horizontal portion 35*a* from the opposite ends of the horizontal portion 35*a***.

The rotary valve 13 has an upper valve plate **13*b* and a lower valve plate 13*a* as shown in FIGS. 5 to 8. The two valve plates 13*a*, 13*b* have a circular shape, respectively, and the upper plate 13*b* has a circular projection 173 at its center which is rotatably inserted into a hole 27 formed at the center of the lower plate 13*a*. The two valve plates 13*a*, 13*b* contact airtightly with each other due to the flat contacting surfaces thereof, lubricating oil fed between the contacting surfaces and a vacuum effect in the rotary valve 13 through the vacuum pipe 28. On the contacting surface of the upper valve plate 13*b* are formed, at equal angular space intervals (90°), four expanded ports 174, 174, . . . 174 in the shape of a fan blade. A circular port 175 opens to the botom of each expanded port 174 and is connected to one end of a flexible tube 14. The other end of the flexible tube 14 is connected to a side wall of a vacuum box 21 (FIG. 1). The upper valve plate 13*b* is pulled by each vacuum box 21 through a flexible tube 14** whereby it is rotated.

Figure 14:
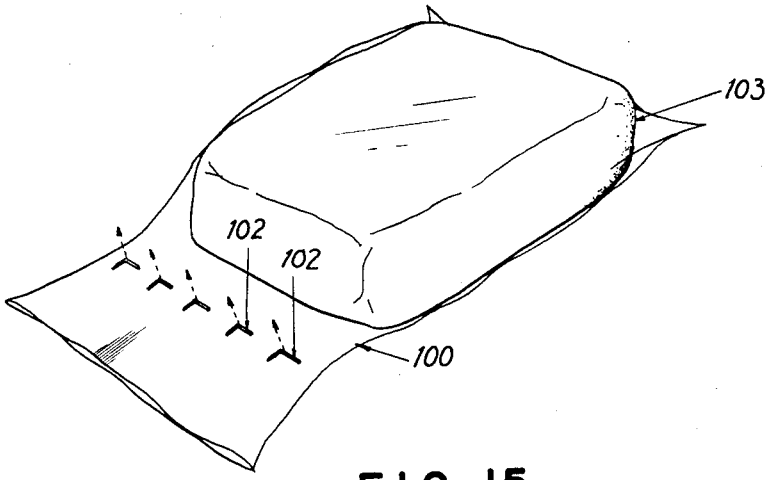
FIG. 14 is a perspective view of a packaging bag with an opening at its one end.

In addition to each port 175, four pressure ports 81, 81, . . . 81 are formed around the projection 73 at equal angular space intervals (90°). Each pressure port 81 is located in a position deviated from that of each corresponding port 175 by a predetermined angular position in the rotational direction of the upper valve plate **13*b*. The four pressure ports 81 are connected to four diaphragm motors 29, 29, . . . 29 fixed to the tops of the vacuum boxes 21, respectively. Each diaphragm motor 29 operates a seal bar 53 for sealing of a packaging bag 100** (FIG. 14).

Figure 7:
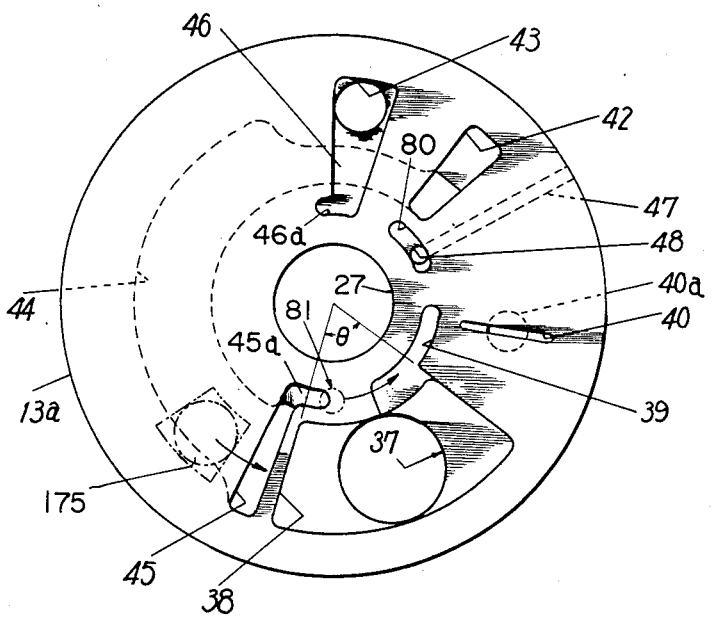
FIG. 7 is a plan view of a lower rotary valve member.
Figure 8:
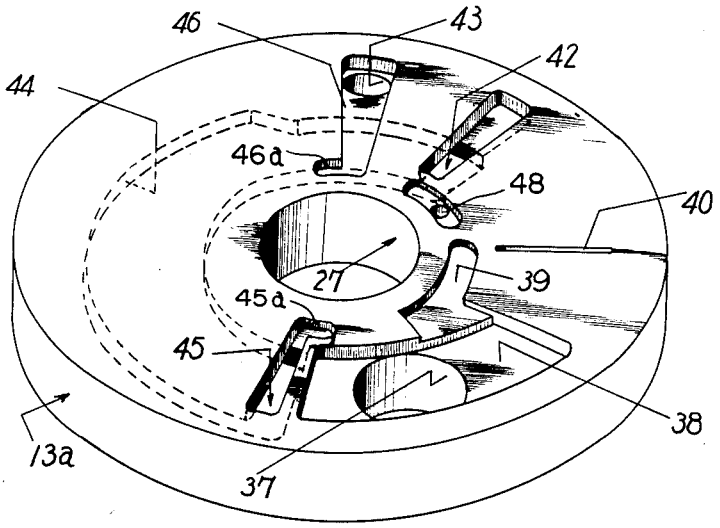
FIG. 8 is a perspective view of the lower rotary valve member.
Figure 9:
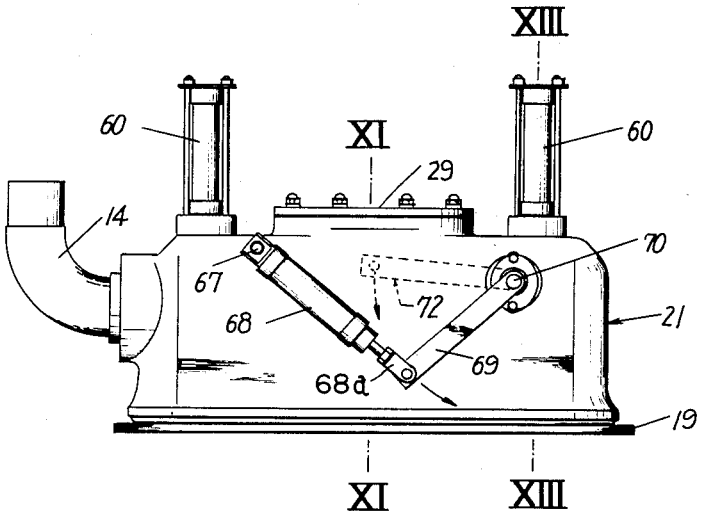
FIG. 9 is a side elevational view of a vacuum box.

As shown in FIGS. 7 and 8, the lower valve plate **13*a* has a fan-shaped or truncated sector expanded port 38 to which a circular vacuum port 37 is opened at its center position. The vacuum port 37 is connected to the upper end of the air passage 26 formed in the column 41 (FIG. 2). The angle $\theta$ subtending a sector including the fan-shaped expanded port 38 is slightly smaller than 90 degrees. On the inner side of the port 38 is formed a shallow hollow 39 projecting in the rotational direction of the upper valve plate 13***b* (counterclockwise direction as viewed in FIG. 7).

On the leftside of the port 38 as viewed in FIGS. 7 and 8 is provided an elongated port 45 in the shape of a boot, which has an arched portion 45*a* extending in the rotational direction thereof at its inner end. Further, a narrow port 40 is formed in a position away from the port 38 in the rotational direction thereof and is connected to the rotational direction through a hole 40*a*. At a position away from the narrow port 40 in the counterclockwise direction is provided a port 42 which is connected to the port 45 through a passage 44 formed in the lower valve plate 13*a*.

Figure 6:
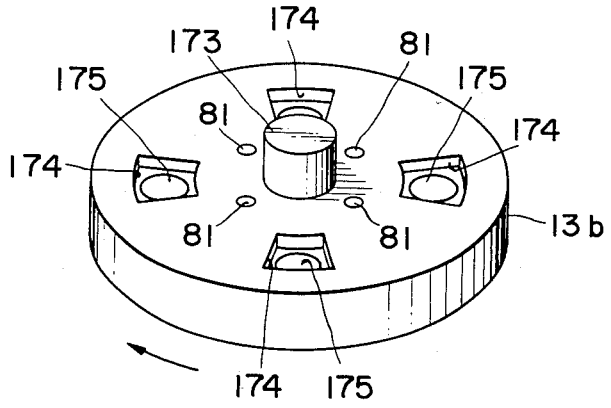
FIG. 6 is a perspective view of the rotary valve.

A pressure passage 47 is formed radially in the lower valve plate 13*a* between the two ports 40, 42. The inner end of the pressure passage 47 is opened to an arched expanded port 80 for feeding pressurized air into a corresponding pressure port 81 formed in the upper valve plate 13*b* (FIG. 6).

In addition to the port 42, there is provided an expanded port 46 for introducing air into each vacuum box 21. The port 46 has, at its outer end, a connecting port 43 which is open to the atmosphere and has, at its inner end, a small arched portion 46*a* to be periodically communicated with the pressure port 81 of the upper valve plate 13*b*.

The structure of each vacuum box 21 will now be explained with reference to FIGS. 9 to 13.

At the outer position of the top wall of the vacuum box 21 in the radial direction of the packaging apparatus is mounted the diaphragm motor 29 having an upper space 54 and a lower space 55 therein partitioned by a diaphragm 51. The upper space 54 is communicated with the slender tube 36 through a port 56 formed at the center of an upper wall 29*a*. The diaphragm 51 is fixed, at its center, to the upper end of a rod 52 which is movable vertically in a bearing portion 29*c* of the lower wall 29*b* of the motor 29. The diaphragm 51 is urged upwardly by a coil spring 57 provided in the lower space 55. The bearing portion 29*c* has at least one groove 58, formed in the inner surface of the bearing portion 29*c*, for communicating the respective interiors of the lower space 55 and the vacuum box 21 with each other. Accordingly, the lower space 55 can be kept at the same pressure as that of the interior (chamber 12) of the vacuum box 21 and the rod 52 is moved vertically in response to the change of the pressure of the upper space 54. The rod 52 supports, at its lower end, a seal bar (heater) 53 for sealing the opening of the packaging bag 100 accommodating a lump of meat 103 and laid on the support plate 19.

The seal bar 53 is disposed in a vertically aligned relationship with a pillow 50 fixed to the support plate 19 and the opening of the bag 100 is extended between the head 50*a* of the pillow 50 and the lower surface of the seal bar 53. On the pillow head 50*a* is disposed nichrome wires for heating the opening of the bag 100.

A cutter blade 63 is located adjacent to the seal bar 53 and has a plurality of sharp cutting edges at its lower end. The cutter blade 63 is supported by two air cylinders 60, 60 disposed at a predetermined space interval in the lateral direction of the vacuum box 21. Each air cylinder 60 is erected on the top wall of the vacuum box 21 and a piston rod 65 is hung in the vacuum chamber from the air cylinder 60 so as to hold the cutter blade 63. The cutting edges of the cutter blade 63 are inserted into a space 61 formed between the side face of the pillow 50 and a guide plate 50*b* when the cutter blade 63 is lowered to cut the opening of the bag 100 after its opening has been sealed.

Figure 10:
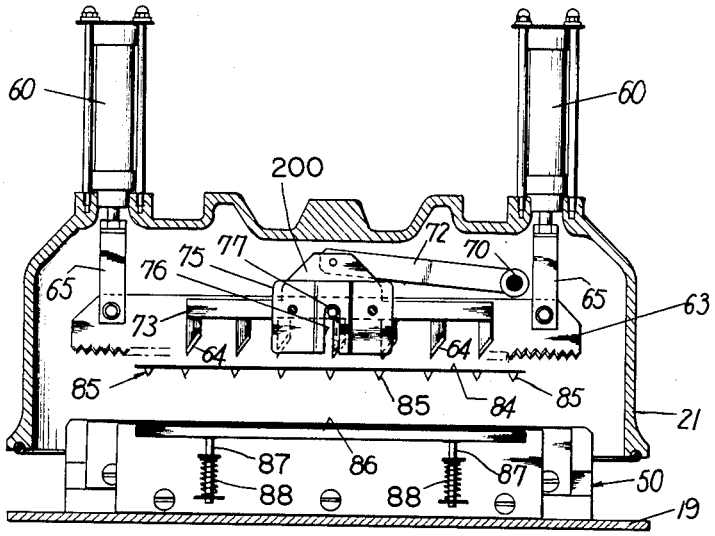
FIG. 10 is a vertical sectional view of the vacuum box, taken along a plane in the lateral direction thereof.
Figure 11:
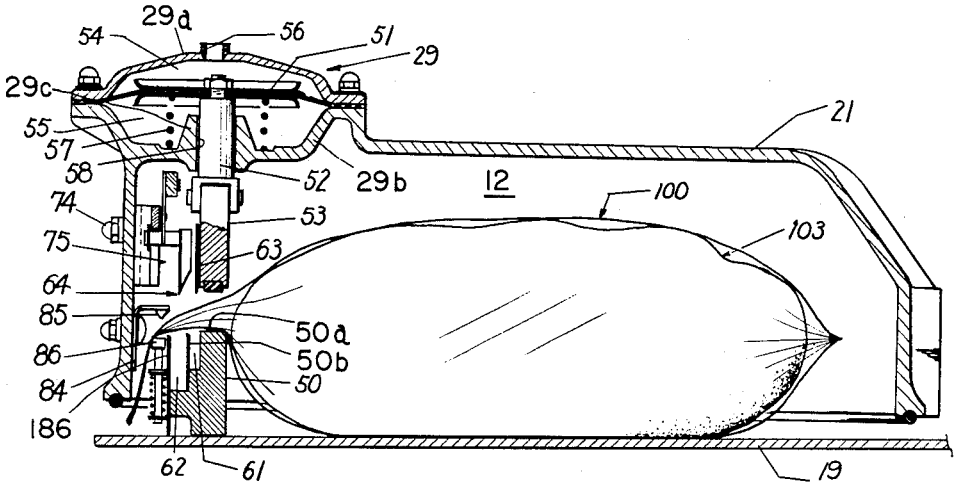
FIG. 11 is a vertical sectional view of the vacuum box, taken along the line XI—XI of FIG. 9.

Along the guide plate 50*b* is disposed a holding plate 186 for holding the leading end of the bag 100 when the leading end is pulled radially outwardly of the vacuum packaging apparatus. Between the guide plate 50*b* and the holding plate 186 is formed a receiving space 62 for receiving a plurality of cutters 64, 64, . . . 64 having an L-shape in section which are supported by a support bar 73. This support bar 73 is hung from a plate 200 which is pivotally connected to one end of an inner link 72 disposed in the vacuum box 21. The other end of the inner link 72 is fixed to a pin 70 pivotally held in the side wall of the vacuum box 21. Further, the pin 70 is fixed to one of an outer link 69 disposed outside the vacuum box 21. The other end of the outer link 69 is connected to a piston rod 68*a* of an air cylinder 68 which is pivotally supported, at its end 67, on the side wall of the vacuum box 21. When the cylinder 68 is expanded, the cutters 64 are lowered to form a plurality of openings 102 for discharging air from the inside of the bag 100 as shown in FIG. 14. When the cylinder 68 is shrunk, the cutter blades 64 are raised as shown in FIG. 10.

A spike pin bar 84 is fixed to the inner wall of the vacuum box 21 at the lower portion of the cutters 64 and has a plurality of spikes 85, 85, . . . 85 for holding the leading end of the bag 100 on a cushion bar 86. The cushion bar 86 is supported by two spaced support axes 87, 87 which are held on the holding plate 186 through two springs 88, 88, respectively.

Figure 12:
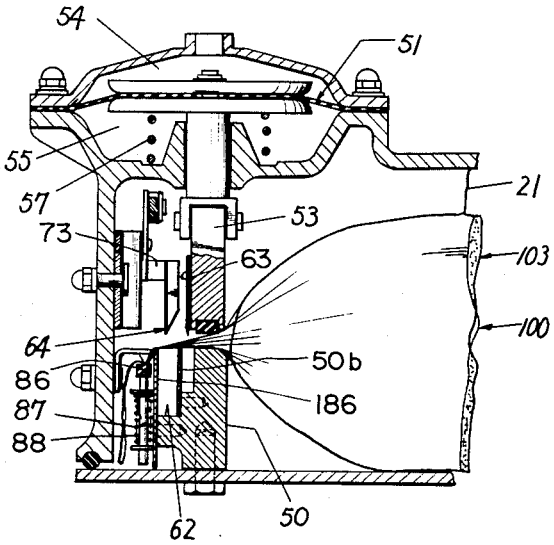
FIG. 12 is an enlarged view of the left half of the vacuum box shown in FIG. 11.
Figure 13:
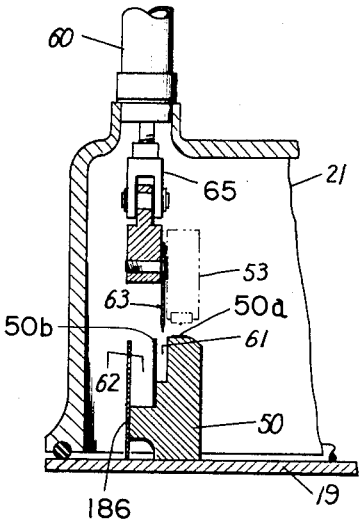
FIG. 13 is a vertical sectional view of the vacuum box, taken along the line XIII—XIII.
Figure 15:
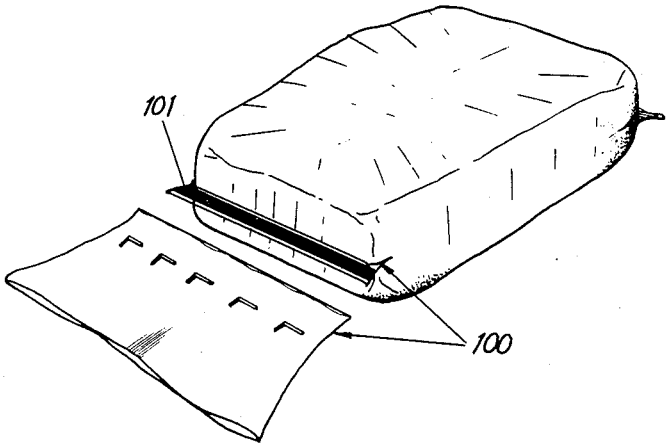
FIG. 15 is a perspective view of a packaged bag in a state wherein a distal end of the bag is cut away.

When the vacuum box 21 is closed, the spikes 85 hold the distal leading end of the bag 100 on the cushion bar 86 as shown in FIG. 12. After this, the cutters 64 are lowered to form a plurality of L-shaped holes 102 as shown in FIG. 14 and the seal bar 53 is then lowered to seal the leading end of the bag 100. At the same time, the leading end of the bag 100 is cut by the cutter blade 63 in response to the operation of the cylinders 60 as shown in FIG. 15.

Figure 16:
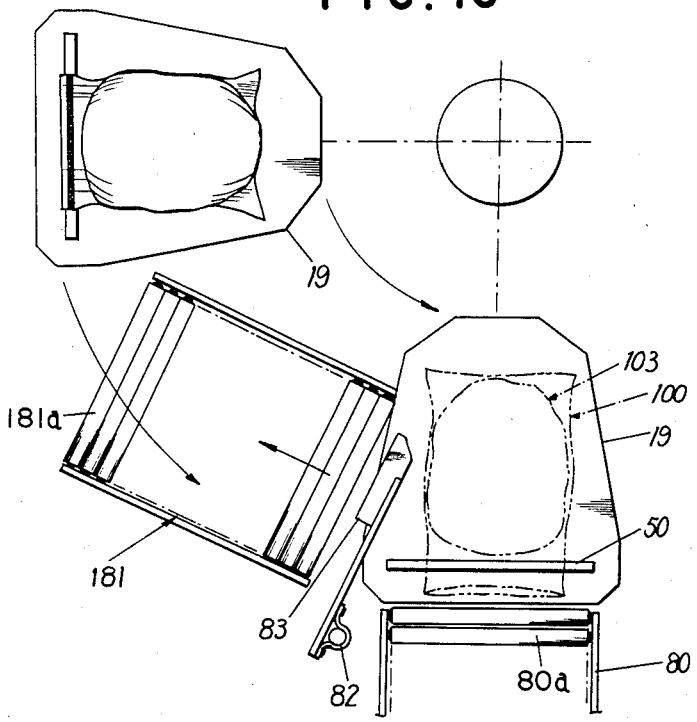
FIG. 16 is a partial plan view showing disposition of a bag discharging conveyor and a stopper plate.
Figure 17:
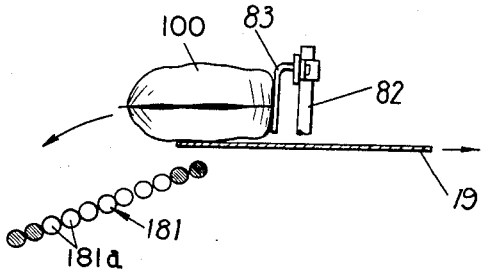
FIG. 17 is an elevational view showing a state wherein the packaged bag is discharged onto the bag discharging conveyor.

As shown in FIGS. 16 and 17, a discharging conveyor 181 comprising a plurality of rollers 181*a*, 181*a*, . . . 181*a* is disposed obliquely under a path along which each vacuum box 21 rotates about the center of the apparatus. In addition, a stopper plate 83 is provided over the path of each vacuum box 21 in order to drop each bag 100 onto the discharging conveyor 181 when each support plate 19 passes by the stopper plate 83 supported by a vertical support bar 82.

Figure 18:
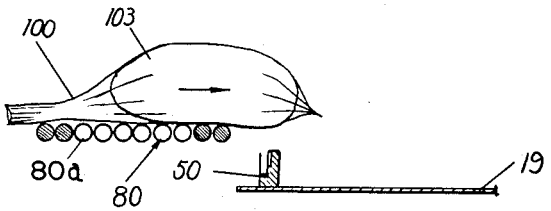
FIG. 18 is an elevational view showing a state wherein a new bag is fed onto the support plate of a vacuum chamber.

Further, a feeding conveyor 80 comprising a plurality of rollers 80*a*, 80*a*, . . . 80*a* is disposed radially outside a path of each support plate 19 so that the bag 100 with a lump of meat 103 therein can be supplied onto each support plate 19 as shown in FIG. 18.

The operation of this vacuum packaging apparatus will now be explained.

Figure 21:
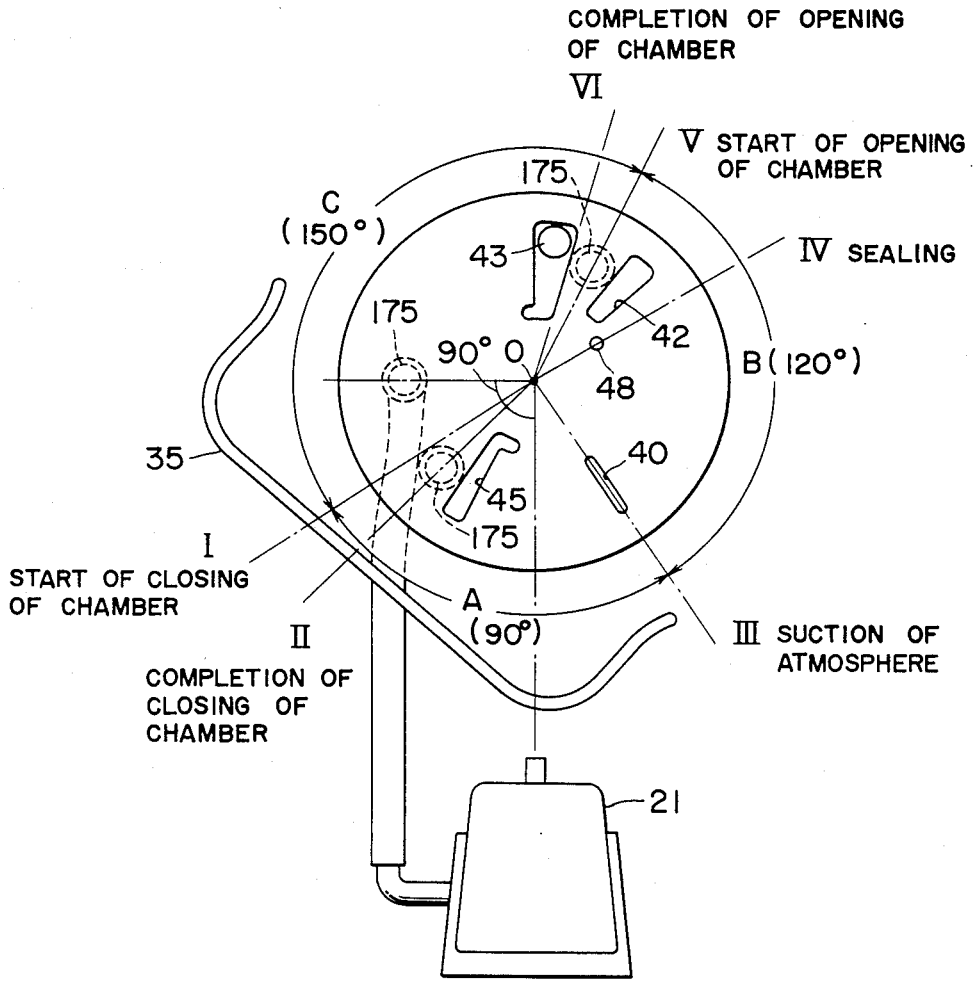
FIG. 21 is an explanatory view showing an operation of a rotary valve.
Figure 22:
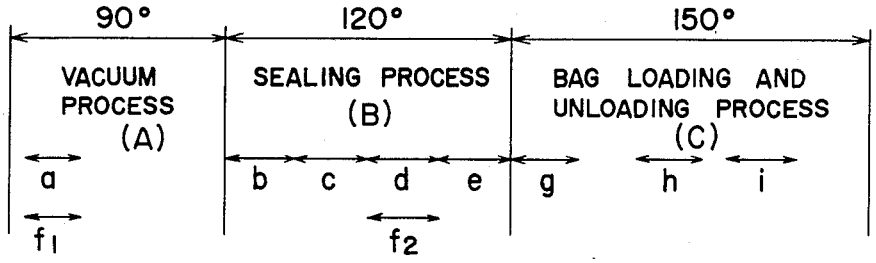
FIG. 22 is an explanatory view showing relationship among vacuum, sealing and bag loading and unloading processes.

In FIGS. 21 and 22, there is a phase difference of 90 degrees between the angular position of each circular port 175 of the upper valve plate 13*b* and that of its corresponding vacuum chamber on the turntable 11.

When the center of the port 175 reaches an angular position I, each chamber stars closing while the chamber passes the border between the horizontal and inclined portions 35*a*, 35*b* of the guide rail 35. Further, when the center of the port 175 reaches an angular position II, the chamber completes its closing. At this time, the contacting point between the roller 34 provided on the pin 32 (FIG. 4) and the rail 35 is moved from an upper position near the pivot pin 31 to a lower position far away from the pivot pin 31. Therefore, at an early stage, the vacuum box 21 is lowered toward the support plate 19 at a high speed thereby to shorten a time period for closing the vacuum box 21. When the vacuum box 21 is lowered near the support plate 19, the vacuum box 21 is moved slowly thereby to be placed calmly on the support plate 19.

After the vacuum box 21 is placed on the support plate 19, the spikes 85 hold the leading end of the bag 100 on the cushion bar 84 and then the cutters 64 are lowered to make openings 12 in the leading end of the bag 100 (opening forming step a).

When the port 175 passes over the port 45, air in the vacuum chamber (backward chamber 21) is partially sucked into a forward chamber located on the opposite side of the chamber on a diameter line (supplementary vacuum step $f_1$). That is, if the forward chamber is completely vacuous, the forward and backward chambers have a pressure of 325 mmHg, respectively, when the forward chamber reaches the port 42. In this manner, as a forward chamber periodically connected to a backward chamber through the passage 44 so that air in the backward chamber is sucked into the forward chamber, a necessary time period for making a vacuum in the backward chamber can be shortened. That is, the vacuum process A can be shortened.

Figure 23:
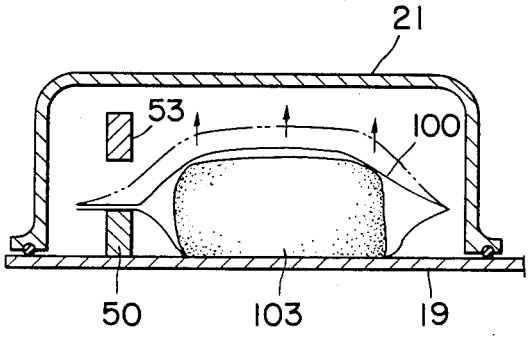
FIG. 23 is an explanatory view showing a stae wherein the packaging bag is expanded when a vacuum is made in the vacuum box.
Figure 24:
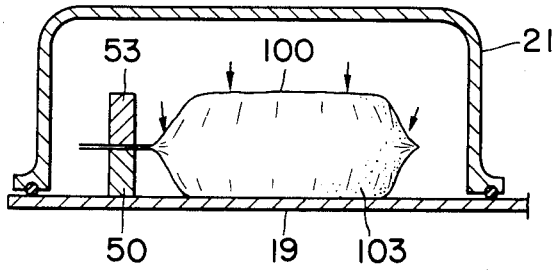
FIG. 24 is an explanatory view showing a state wherein the packaging bag is shrunken when a small amount of air is sucked in the vacuum chamber during a sealing process.

After the supplementary vacuum step $f_1$, the port 175 reaches the shallow expanded port 38 and a main vacuum process starts to make a complete vacuum in the bag 100 as well as in the chamber. When the port 175 reaches the forward end of the shallow port 38, the pressure port 81 reaches the shallow hollow 39 to equalize the pressures of the lower and upper spaces 55, 54 of the diaphragm motor 29 with each other. Accordingly, the seal bar 53 is kept in an upper position. With this state, when the port 175 reaches the narrow port 40 at an angular position III, a small amount of atmospheric air is sucked into the chamber so that the pressure in the chamber is increased by approximately 110 mmHg (preliminary air sucking step b). The increase of the pressure in the chamber shrinks the bag 100, as shown in FIG. 24, which has been expanded under a vacuum as shown in FIG. 23.

Shortly after this step b, the pressure port 81 reaches the port 48 at a position IV to supply pressurized air into the upper space 54 of the diaphragm motor 29 whereby the seal bar 53 is lowered to seal the leading end of the bag 100 on the pillow head 50*a*. At this time, heat is supplied to the pillow head 50*a* by impulse electric current (heat sealing step c). Then, the cutter 63 is lowered to cut the outer end of the leading end of the bag 100 away from a sealed portion 101 thereof as shown in FIG. 15 (sealing portion cutting step d). The port 175 reaches the port 42 connected to the port 4 shortly after the cutting step d to carry out air sucking step $f_2$ in which air is sucked, through the passage 44, from the backward corresponding vacuum chamber on the same diameter line (at a position opposite to the forward vacuum chamber with respect to an axis of the turntable 11). In this step $f_2$, the pressure of the vacuum box located over the port 42 is increased to a value of 325 mmHg while the sealed portion 101 is being held by the seal bar 53 (sealed portion holding step e) until its temperature is decreased to some extent.

In this manner, when the forward vacuum chamber sucks air from the backward vacuum chamber, the bag 100 shrinks to a certain degree. However, in this invention, as the bag 100 is preliminarily shrunk to some extent during the preliminary air sucking step b, the bag 100 is not shrunk very much during the air sucking step $f_2$. Accordingly, the shrinkage of the bag 100 in the step $f_2$ does not cause the leading end of the bag 100 to tear off from the sealed portion 101 even if the step $f_2$ is carried out before the heated portion 101 is not cooled down completely. Especially if an article within the bag 100 is very heavy, the leading end of the bag 100 is apt to tear off unless the preliminary shrinkage (air sucking) step b is carried out. According to this invention, the seps c, $f_2$ can be carried out at almost the same time thereby to shorten the time period of the sealing process B. In this invention the angular range of the sealing process B is approximately 120 degrees.

When the port 175 reaches an angular position V, the roller 34 of the connecting arm 71 contacts, at its lower part, the lower part of the inclined portion 35*b* as shown in FIGS. 4 and 21. As the vacuum chamber 12 moves forward, the contacting point between the roller 34 and the rail 35 is moved toward the pivot pin 31 along the surface of the roller 34 thereby to open the vacuum box 21 (chamber opening step g). Accordingly, at the beginning of the chamber opening step g, a big force is exerted on the connecting arm 71 because of a long distance between the contacting point and the pivot pin 31 whereby the vacuum box 21 can be separated smoothly from the support plate 19. After the vacuum box 21 is once separated away from the support plate 19, a big force is not necessary for further swinging it. Therefore, even if the contacting point is moved near the pivot pin 31, the vacuum box 21 can be easily swingable further. At this time, the coil springs 30 contribute to open the vacuum box 21 in addition to the contact between the rail 35 and the roller 34. In addition, when the vacuum box 21 is moved through an angle, the shorter the distance between the contacting point and the pivot pin 31 becomes, the larger the upward swinging angle of the vacuum box 21 becomes. Therefore, at the beginning of the chamber opening step g, the vacuum box 21 is swung relatively slowly while late in the step g, the vacuum box 21 is swung quickly.

After the center of the port 175 reaches an angular position V, atmospheric air is sucked into the chamber through the port 46 and the vacuum box 21 is completely opened at an angular position VI. With this state, the chamber 12 is resolved further about the center of the apparatus, the packaged bag 100 abuts the stopper plate 83 to discharge it onto the discharging conveyor 181 as shown in FIG. 17 (packaged bag unloading step h).

Thereafter, a new bag 100 having not been packaged is supplied onto the empty supporting plate 19 in a manner that the leading end of the bag 100 can be laid on the pillow head 50*a* (bag loading step i). When the bag 100 is supplied onto the supporting plate 19, an operator must hold the opposite sides of the leading end of the bag 100 in order to lay the leading edge correctly on the pillow head 50*a*.

After the completion of the bag loading step i, the vacuum box 21 starts closing at the position I.

According to this invention, as the vacuum box 21 can be closed and opened through a narrow angle because of the engagement of the roller 34 and the rail 35, the vacuum process A can be carried out through a relatively narrow angle because of the provision of the supplementary vacuum step $f_1$ and the sealing process B can be carried out through a relatively narrow angle because of the provision of the preliminary air sucking process b, the bag loading and unloading process c can occupy a wide angular range (approximately 120 degrees). Accordingly, even if the apparatus is small in size, a necessary time for loading and unloading bags can be ensured. In conclusion, according to this invention, the apparatus can be made compact.

What is claimed is:

1. A method for packaging relatively large articles in a plurality of vacuum chambers each comprising a vacuum box and a support plate and disposed on a periphery of a turntable, which comprises steps of:

(a) feeding each article to be packaged onto a support plate of a vacuum chamber at an angular position of the turntable in a state wherein the article is accommodated in a packaging bag, at least one end of which is opened;

(b) closing said vacuum chamber after feeding of each article into the vacuum chamber;

(c) thereafter discharging an amount of air from the vacuum chamber containing the article into a forward vacuum chamber which is disposed at a position opposite to the vacuum chamber with respect to an axis of the turntable so that pressure of the vacuum chamber is decreased to an intermediate level;

(d) forming a vacuum in the vacuum chamber while the vacuum chamber moves through a predetermined angular range of the turntable;

(e) thereafter sucking a small amount of atmospheric air into the vacuum chamber in order to shrink preliminarily the packaging bag;

(f) thereafter sealing the open end of the packaging bag by heating it while holding it tightly;

(g) subsequently sucking an amount of air from a backward vacuum chamber disposed at a position opposite to the vacuum chamber with respect to the axis of the turntable into the vacuum chamber containing the packaged article;

(h) sucking atmospheric air into the vacuum chamber to open it; and (i) discharging the article having been packaged from the vacuum chamber, each above step being carried out during one rotation of the turntable.

2. A method according to claim 1, wherein a rotary valve is provided at the center of the turntable, a rotatable member of the rotary valve being connected to each vacuum chamber in such a manner that the rotatable member is rotated to operate the rotary valve.

3. A method according to claim 1, wherein a vacuum box of each vacuum chamber can be pivotably supported on the turntable and has a roller contacting a guide rail to swing the vacuum box, the contacting point between the guide rail and a surface of the roller being moved as the roller moves along the guide rail when the vacuum box is opened and closed.

4. An apparatus for packaging relatively large aricles with packaging bags in a vacuum environment, comprising:

(a) a plurality of vacuum chambers each comprising a vacuum box capable of opening and closing and a support plate on which each article accommodated in a packaging bag is laid and disposed on a periphery of a turntable rotating at a speed;

(b) means for opening and closing the vacuum box with respect to the support plate;

(c) a rotary valve for controlling air pressure of each vacuum chamber, the rotary valve comprises a first port for discharging an amount of air in a vacuum chamber containing the article therefrom into a forward chamber which is disposed at a position opposite to the vacuum chamber with respect to an axis of the turntable, a second port for sucking air in each vacuum chamber to make a vacuum therein, a third port for sucking a small amount of atmospheric air into each vacuum chamber for preliminary shrinkage of the packaging bag, a fourth port for sucking an amount of air in a backward vacuum chamber connected to the first port into the vacuum chamber which is disposed at a position opposite to the backward vacuum chamber with respect to the axis of the turntable, a fifth port for sucking sufficient atmospheric air into each vacuum chamber and a passage for connecting the first port to the fourth port, the first to fifth ports being arranged in order in the rotational direction of the turntable so that each chamber is periodically connected to the first to fifth ports in order during one rotation of the turntable;

(d) means for discharging the article having been packaged with the packaging bag from the support plate; and (e) means for feeding each of new articles onto each support plate, each article being accommodated in the packaging bag with at least its one end open.

5. An apparatus according to claim 4, wherein each vacuum box comprises a seal bar for sealing the opening end of the packaging bag by heating it and a diaphragm motor for operating the seal bar, the motor being connected to a port of the rotary valve for feeding compressed air into the motor.

6. An apparatus according to claim 4, wherein the rotary valve is disposed over the turntable and comprises an upper rotatable valve member with a plurality of ports each connected to each vacuum chamber through a flexible tube and a lower stationary valve member airtightly contacting the upper rotatable valve member, the upper rotatable valve member being rotated on the lower valve member by being pulled by each vacuum chamber rotating with the turntable.

7. An apparatus according to claim 4, wherein each vacuum box is supported swingably by the turntable through a connecting arm urged by a spring in a manner that the vacuum box is opened and a pivot pin, the connecting arm having a roller rolling along a guide rail which is so formed that the contacting point between the roller and the guide rail is moved toward a pivot portion of the connecting arm as the degree of the opening of the vacuum box is increased when the vacuum box is opened and closed.

8. An apparatus according to claim 4, wherein the vacuum box has a spike pin bar with a plurality of spikes on its inner wall to hold a distal leading end of the packaging bag together with a cushion bar provided along a pillow on the support plate of the chamber.

9. An apparatus according to claim 4, wherein the packaged article discharging means has a stopper plate provided over a path of each support plate so that the packaged article is dropped from the support plate.

* * * * *